US007433821B2

(12) United States Patent
Obranovich et al.

(10) Patent No.: US 7,433,821 B2
(45) Date of Patent: Oct. 7, 2008

(54) METHODS AND SYSTEMS FOR INTELLIGIBILITY MEASUREMENT OF AUDIO ANNOUNCEMENT SYSTEMS

(75) Inventors: Charles R. Obranovich, Blaine, MN (US); Philip J. Zumsteg, Shorewood, MN (US); Andrew G. Berezowski, Wallingford, CT (US); Walter Heimerdinger, Minneapolis, MN (US); John A. Phelps, Minneapolis, MN (US); D. Michael Shields, St. Paul, MN (US)

(73) Assignee: Honeywell International, Inc., Morristown, NJ (US)

( * ) Notice: Subject to any disclaimer, the term of this patent is extended or adjusted under 35 U.S.C. 154(b) by 295 days.

(21) Appl. No.: 11/064,414

(22) Filed: Feb. 23, 2005

(65) Prior Publication Data

US 2005/0216263 A1 Sep. 29, 2005

Related U.S. Application Data

(63) Continuation-in-part of application No. 10/740,200, filed on Dec. 18, 2003.

(51) Int. Cl.
*H04R 27/00* (2006.01)

(52) U.S. Cl. ..... 704/270; 381/82; 340/286.05

(58) Field of Classification Search ..... 704/270; 381/82, 83; 340/286.5
See application file for complete search history.

(56) References Cited

U.S. PATENT DOCUMENTS 6,978,159 B2 * 12/2005 Feng et al. ..... 455/570
7,076,072 B2 * 7/2006 Feng et al. ..... 381/313
2002/0099551 A1 7/2002 Jacob ..... 704/270
2002/0107692 A1 8/2002 Litovsky ..... 704/270

OTHER PUBLICATIONS

Steele, Mike, Sr., "The Speech Transmission Index Program is Up and Running", Press Release, Research Division Lexington Center, 11 pgs., Sep. 2003.

SimplexGrinnell and Gold Line Jointly Announce a New Technology for Complying with Fire Alarm Voice Intelligibility Requirements, STI Product Information Brochure, 5 pgs., May 2002.

Gold Line Brochure "Information on New Safety & Security Test and Measurement System", 4 pgs., May 2002.

Jacob, Kenneth, "Understanding Speech Intellilgibility and the Fire Alarm Code", National Fire Protection Association Congress, Anahem, CA, 25 pgs., May 14, 2001.

Steeneken, Herman et al., "Development of an Accurate, Handheld, Simple-to-use Meter for the Prediction of Speech Intelligibility", 11 pgs., presented at Reproduced Sound 17, Stratford-on-Avon, Nov. 16, 2001.

Steeneken, Herman, "The Measurement of Speech Intelligibility", 8 pgs., May 2002.

(Continued)

*Primary Examiner*—Abul Azad
(74) *Attorney, Agent, or Firm*—Husch Blackwell Sanders Welsh & Katz

(57) ABSTRACT

A measurement system and method combine an audio announcement system with a plurality of spaced apart wirelessly coupled devices which evaluate speech intelligibility of audio output from loudspeakers of the audio announcement system. Processing can take place at some or all of the devices as well as at a common control element. Evaluations can be based on use of a method which maps to a Common Intelligibility Scale.

25 Claims, 3 Drawing Sheets

OTHER PUBLICATIONS

Letter from Herman J.M. Steeneken to Gregory J. Miller, Esq. TEF Division of Gold Line, May 2002.
"Intelligibility Scores at Gillette Stadium", Feb. 2003 edition of Systems Contractor News, 5 pgs.
PCT International Search Report; International App. No. PCT/US06/03144, 2 pages (Mar. 15, 2007).
PCT Written Opinion of the International Searching Authority; International App. No. PCT/US06/03144, 4 pages (Mar. 15, 2007).

* cited by examiner

METHODS AND SYSTEMS FOR INTELLIGIBILITY MEASUREMENT OF AUDIO ANNOUNCEMENT SYSTEMS

CROSS REFERENCE TO RELATED APPLICATION

This application is a continuation-in-part of U.S. patent application Ser. No. 10/740,200 filed Dec. 18, 2003 and entitled, "Intelligibility Measurement of Audio Announcement Systems."

FIELD OF THE INVENTION

The invention pertains to systems and methods of evaluating the quality of audible output provided to assist or inform individuals in a region. More particularly, the intelligibility of provided audio is evaluated in wireless units by sensing a plurality of predetermined audible outputs, from an audio output transducer, and, evaluating intelligibility thereof on a per region basis.

BACKGROUND

It has been recognized that speech being projected or transmitted into a region is not necessarily intelligible merely because it is audible. In many instances such as sports stadiums, airports, public buildings and the like, speech delivered into a region may be loud enough to be heard but it may be unintelligible. Such considerations apply to audio announcement systems in general as well as those which are associated with fire safety, building or regional monitoring systems.

Relative to the latter, it has been known to conduct intelligibility testing in connection with such systems by having an installer or technician walk through a building or region being evaluated and listen to output from various speakers of the public address or alarm evacuation system to assess the intelligibility of the instructions or information being output by such devices. In an alternate mode, portable intelligibility analyzers can be carried through the building to each region of interest to provide a quantitative measure of speech intelligibility.

It also has been recognized that testing as described above requires that the installer or technician must literally move through most of the building or region being evaluated to listen or measure the intelligibility of speech signals being delivered in each region. This process is not only time consuming but expensive especially in large buildings. Additionally, when a floor or a portion of the region is being redecorated or built out for a different tenant, that portion of the building or region must be re-evaluated at additional cost of time and money after the construction and/or build-out has been completed.

It would be desirable to in some way make use of some or all of the existing equipment of such systems to improve intelligibility testing/evaluation. In such event, more frequent evaluation/testing could be conducted throughout the region or building monitored.

It also has been recognized that there is a benefit in moving from subjective evaluation of the intelligibility of speech in a region toward a more quantitative approach which, at the very least, provides a greater degree of repeatability. A standardized quantitative measure of speech intelligibility is the Common Intelligibility Scale (CIS). Various machine-based methods such as Speech Transmission Index (STI), Speech Transmission Index Public Address (STI-PA), Speech Intelligibility Index (SII), Rapid Speech Transmission Index (RASTI), and Articulation Loss of Consonants ($AL_{cons}$) can be mapped to the CIS. These test methods have been developed for use in evaluating speech intelligibility automatically and without any need for human interpretation of the speech intelligibility.

In the majority of machine-based testing a noise or noise-like signal is amplitude modulated at various rates. The signal is transmitted from a source, such as a loud speaker, into a portion of a region of interest. The signals are detected, for example by an acoustic sensor. The received signals are analyzed by comparing the depth of modulation thereof with that of the test signal. Reductions in modulation depth of received signals are associated with loss of intelligibility.

Details of machine-based evaluations have been published and are available for example in "The Modulation Transfer Function In Room Acoustics as a Predictor of Speech Intelligibility" by Steeneken and Houtgast, Acustica V28, PG66-73 (1973) and "A Review of the MTF Concept in Room Acoustics and its Use for Estimating Speech Intelligibility in Auditoria" by Steeneken and Houtgast, Institute for Perception TNO, Soesterberg, the Netherlands (1984).

The above described evaluation process can be carried out by any one of a variety of publicly available analysis programs as would be available to those of skill in the art. One such program has been disclosed and discussed in an article, "The Speech Transmission Index Program is Up and Running", Lexington Center and School for the Deaf, V3.1 (Sep. 9, 2003). Other programs for evaluating CIS-mappable intelligibility evaluation are available as would be known to those of skill in the art.

There thus continues to be on ongoing need for improved, more efficient, intelligibility testing in connection with fire safety/evacuation voice announcement systems. It would be desirable if the recognized benefits of CIS-mappable processing could be incorporated into such systems to improve intelligibility testing thereof. It also would be desirable to be able to incorporate such functional capability in a way that takes advantage of easily installable, wireless device which are intended to be distributed throughout a region being evaluated so as to minimize additional installation cost and/or equipment needs. Preferably such functionality could not only be incorporated into the devices being installed, but also could be cost effectively incorporated as upgrades to existing systems.

DETAILED DESCRIPTION OF THE PREFERRED EMBODIMENT

Figure 1:
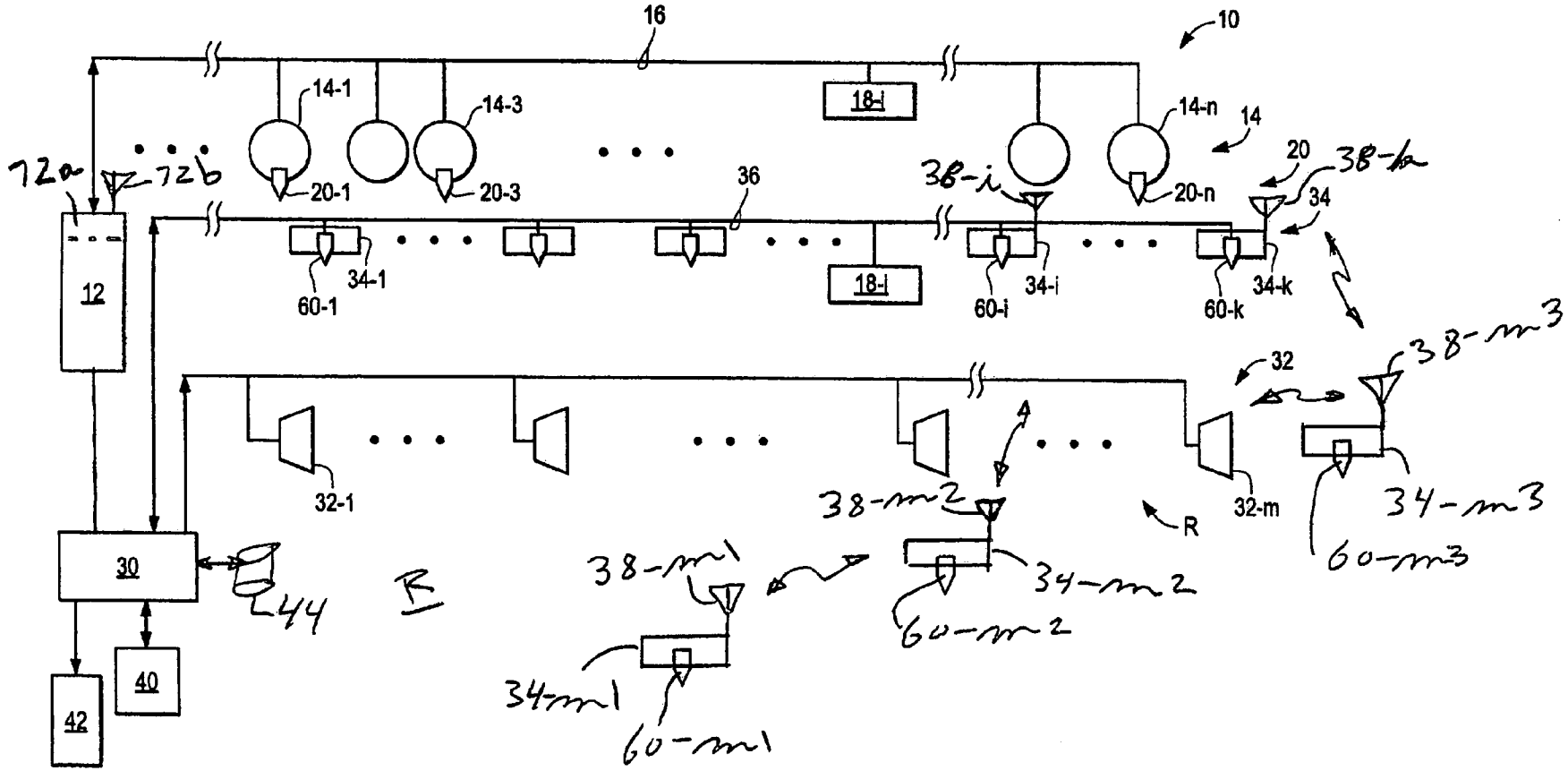
FIG. 1 is a block diagram of an intelligibility evaluation system in accordance with the invention.

While this invention is susceptible of an embodiment in many different forms, there are shown in the drawing and will be described herein in detail specific embodiments thereof with the understanding that the present disclosure is to be considered as an exemplification of the principles of the invention. It is not intended to limit the invention to the specific illustrated embodiments.

In accordance with the invention, intelligibility evaluation can be incorporated in an audio announcement system. In one embodiment, devices incorporating one or more acoustic sensors can be located throughout a region or building being evaluated. Circuitry associated with the respective acoustic sensors can carry out CIS-mappable measurement processing of audio received from one or more speakers, which would be associated with building or regional audio announcement systems. The devices can include a wireless transceiver to receive commands and to communicate CIS-mappable measurements to a nearby wired system. Wireless devices can function as repeaters for one another thereby increasing the size of the region which can be evaluated.

In one aspect, to carry out an intelligibility evaluation, a sequence of CIS-mappable test signals are delivered from one or more loudspeakers. The signals can be received by one or more acoustic sensors and then, locally, evaluated using a CIS-mappable process. Alternately, the signals received by one or more acoustic sensors can be communicated to a common location for evaluation.

Where the evaluation is conducted at least in part locally at the respective acoustic sensor(s), the calculated CIS-mappable value or other value, can be transmitted wirelessly directly or via another device to a control console for storage, operator review, and evaluation.

It also will be understood that wireless devices can receive and retransmit CIS-mappable values and zone specifying information from other wireless devices, to associated wired devices, or a regional monitoring system. This repeater-like operation will extend the range of the transceivers of the respective wireless devices.

The system enables an operator, from a common control console, to evaluate speech intelligibility throughout the building or region or only in certain zones at any given time. Additionally, regular evaluations can be scheduled and carried out automatically during off-peak hours such as overnight, on weekends, and the like. A parent application hereto, No. 10/740,200 filed Dec. 18, 2003 assigned to the assignee hereof is incorporated herein by reference.

FIG. 1 illustrates a system 10, which could be a fire alarm system of a known type usable for monitoring a region R. The system 10 includes common control circuitry or a fire alarm control panel 12. The system 10 can include a plurality of ambient condition detectors 14. The detectors 14 could for example be smoke detectors, thermal detectors or gas detectors or combinations thereof all without limitation. Those of skill in the art would understand the specific types of structures which are available to implement such detectors. Units such as 18-i represent local processing devices, discussed subsequently.

The detectors 14 are in communication with the control panel 12 via a wired or wireless medium indicated generally as 16. In one embodiment, some of the detectors, such as 14-1, 14-3 and 14-n also include acoustic sensor(s) indicated generally as 20-1, 20-3 and 20-n. The acoustic sensor(s) 20-1 . . . 20-n could be incorporated in only some or in all of the detectors 14.

As discussed in more detail subsequently, signals received via acoustic sensor(s) 20-1 . . . 20-n could be processed partially or completely at the respective detector 14-1 . . . 14-n. Alternatively, some or all of the processing could be carried out at various system devices 18-i or at control panel 12. It will be understood that signals from acoustic sensor(s) 20-1 . . . 20-n could be transmitted in a variety of ways, wirelessly or via medium 16, to control panel 12 all without limitation.

Region R can also incorporate an audio announcement system 30 which could be coupled to or be a part of the control panel 12. The audio announcement system 30 incorporates one or more loudspeakers 32-1 . . . 32-m located throughout the region R. The speakers 32-1 . . . 32-m could be used, as would be understood by those of skill in the art, for audibly outputting routine messages to people working or present in the region R. Alternately, the speakers 32-1 . . . 32-m could be used, in connection with system 10 to advise individuals in the region R of a hazardous condition, such as a fire or the like and provide information and instructions thereto.

System 30 also can include coupled thereto one or more devices 34 such as 34-1 . . . 34-k located throughout the region R in addition to or in lieu of the detector(s) 14. Devices 34 can be coupled to system 30 and/or the alternative processing nodes 18-i wirelessly or by a wired medium 36. Devices 34 include one or more acoustic sensor(s) 60, such as 60-i.

A source of test signals 40 could be coupled to audio announcement system 30 either acoustically or electrically, without limitation, to provide intelligibility test signals to be output via speakers 32 throughout the region R. The test signals could be, for example, STI-test signals, RASTI, SII test signals, subsets thereof or other types of standardized test signals usable to evaluate CIS-mappable intelligibility as would be understood by those of skill in the art.

In response to the output from the speakers 32, acoustic sensor(s) 20, 60, receive audio input corresponding thereto based on their respective physical relationships with the members of the plurality 32. The microphones 20, 60 could also be coupled to local processing circuitry to carry out CIS-mappable evaluation processing. The evaluation results can then be communicated to control panel 12 via medium 36. Alternately, modular devices 18-i can receive the local audio from units 34-i, to formulate, at each location, an STI value, an RASTI value, an SII value or any other type of CIS-mappable value without limitation.

The respective CIS-mappable values can be determined at the respective acoustic sensor locations and transmitted via media 16 or 36 respectively to control panel 12 and/or audio announcement system 30. A zone or device identifier can also be transmitted along with the respective CIS-mappable value(s). The respective values can be presented, for example on graphical display 42 for review by operational personnel. Graphical display 42 may communicate with various parts of the system via wired or wireless communication. A storage unit 44 can be included to store evaluation results. It will be understood that display 42 and storage unit 44 can also be coupled or interfaced to control panel, or control circuits 12.

Alternately, some or all of the CIS related processing could be carried out at control panel 12 without departing from the spirit and scope of the invention. In such an embodiment, signals from the acoustic sensor(s) could be digitized and communicated using a digital protocol to panel 12.

To improve regional coverage particularly where wired media, such as 16 or 36 are not readily available, wireless devices such as 34-m1, m2, m3 . . . mi can be installed. Such devices include an acoustic sensor 60-mi, coupled to local processing circuitry to carry out local processing to produce a CIS-mappable intelligibility value.

Each of the devices 34-mi include a wireless transducer, such as 38-mi, for wireless reception and transmission of values. The devices 34-mi are not only in wireless communication with one another, they can also be in wireless communication with units such as 34-i, 34-k which are in wired communication with 12.

Wireless units can thus be installed throughout region R to improve speech intelligibility evaluation. They can communicate directly with wired devices, fire alarm control panels, audio announcement systems and the like. They can also function as repeaters for those wireless devices that are too far from the wired system. Such devices can transmit, for example, the calculated CIS-mappable values along with an ID code or zone identifier.

The above described intelligibility evaluation process can be carried out automatically throughout the region R at any appropriate time and the results stored and presented to the operation personnel subsequently. It also has the advantage that if the space in the region R is in part reconfigured, the process can be again initiated and carried out to determine or establish the intelligibility of audio throughout the revised portion of the region R.

Because the evaluation involves interactions between audio from speakers 32 which is in turn sensed by acoustic sensor(s) 20, 60 as well as those of wireless devices such as 34-m1, m2, m3 . . . mi, no operating personnel need travel through the region R as part of the evaluation process. Finally, the CIS-mappable values provide a quantitative assessment of intelligibility and eliminate subjective influences which may be present where individuals are attempting to evaluate intelligibility based on their own perceptions.

It will also be understood that none of the exact details of the devices such as detectors 14, 34, local processing devices, such as 18-i, acoustic sensor(s) 20, 60, 34-mi, or speakers 32 represent limitations of the present invention. Similarly, the numbers of such devices are also not limitations of the present invention. Finally, the location of the CIS-mappable processing, which can in part be located at each of the respective detectors 14, local processing nodes 18, wireless units 34-mi, or, at the control panel 12, all without limitation, is not a limitation of the invention.

The control panel 12 could also incorporate a transceiver 72*a* and wireless transducer 72*b* for communication with wireless devices as described above. Wireless transmissions can include RF or infrared, or other types of wireless communications all without limitation.

Figure 2A:
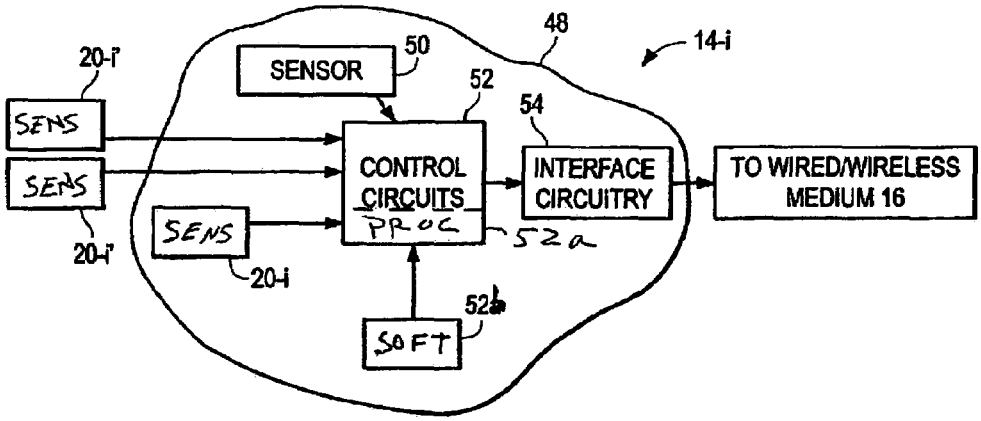
FIG. 2A is a block diagram illustrative of a device incorporating one or more ambient condition sensors and one or more acoustic sensors and usable in the system of FIG. 1.

FIG. 2A, a block diagram illustrates additional details of a representative detector 14-i having a housing 48 which carries a acoustic sensor 20-i and provisions for connections to several optional external acoustic sensor(s) such as 20-i'. Housing 48 can be mounted on or adjacent to a selected surface in region R. Detector 14-i includes at least one ambient condition sensor 50 which could be implemented as a smoke sensor, a flame sensor, a thermal sensor, a gas sensor or a combination thereof.

Outputs from sensor 50 and acoustic sensor(s) 20-, 20-i', are coupled to control circuitry 52 which could be implemented, in part, with hard wired circuits or a processor 52*a* for executing pre-configured software or instructions 52*b*. Instructions 52*b* could include processing instructions for establishing a CIS-mappable value or subsets thereof, all without limitation in response to incoming audio sensed at acoustic sensor at 20-i.

Outputs from circuits 52 can include values indicative of outputs from sensor 50 as well as acoustic sensor 20-i or, the processed intelligibility values in whatever form is preferred. Those outputs are coupled via interface circuitry 54 to medium 16 for transmission to control system or fire alarm control panel 12. It will also be understood that the interface 54 can carry out bi-directional communication between the medium 16 and the detector 14-i if desired, all without limitation.

Figure 2B:
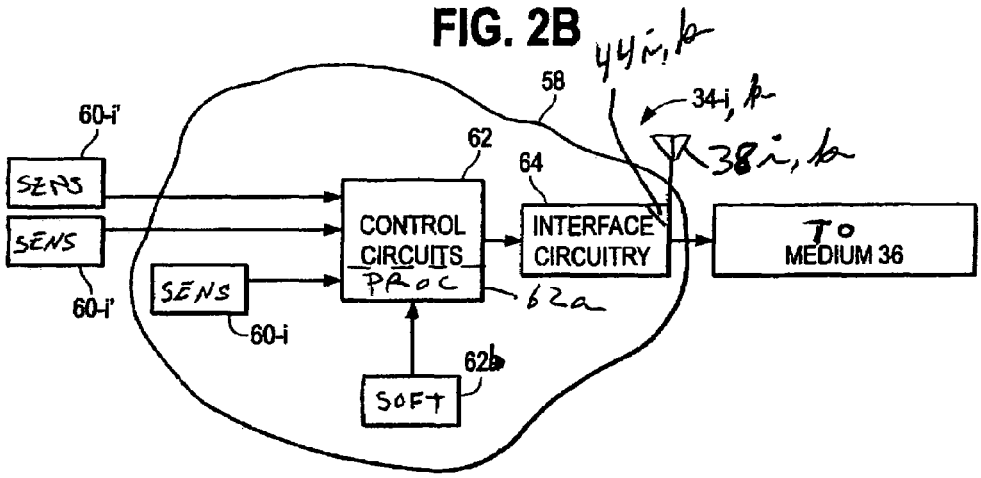
FIG. 2B is a block diagram of an exemplary device incorporating one or more acoustic sensors and usable in the system of FIG. 1.

FIG. 2B illustrates, in block diagram form, a member 34-i or 34-k of the plurality 34. Device 34-i includes a housing 58 which is mountable on a selected surface in the region R. Housing 58 may include an acoustic sensor, such as 60-i and provisions for connections to several optional external acoustic sensors 60-i' which are in turn coupled to control circuits 62. Circuits 62 could include both hard wired circuits and/or a processor 62*a* for executing pre-stored instructions or logic 62*b*, as desired, for carrying out CIS-mappable processing and producing a value internally to the device 34-i, 34-k. The control circuits 62 can in turn transfer the generated value, via interface circuit 64 and medium 36 to control panel 12 for analysis and presentation as desired on display 42, for example.

The interface circuitry 64 can include a port for connection with a wired medium such as medium 36. Additionally, it can include a wireless transducer 38i or 38k respectively in devices 34i, k and an associated transceiver 44-i, k. Wireless CIS-mappable values/zone identification signals from any or all of the units 34-mi can be received by the respective wireless transducer(s) 38i, 38k (and associated transceiver). Those signals can in turn be communicated via wired medium 36 to control panel 12 for presentation.

Figure 2C:
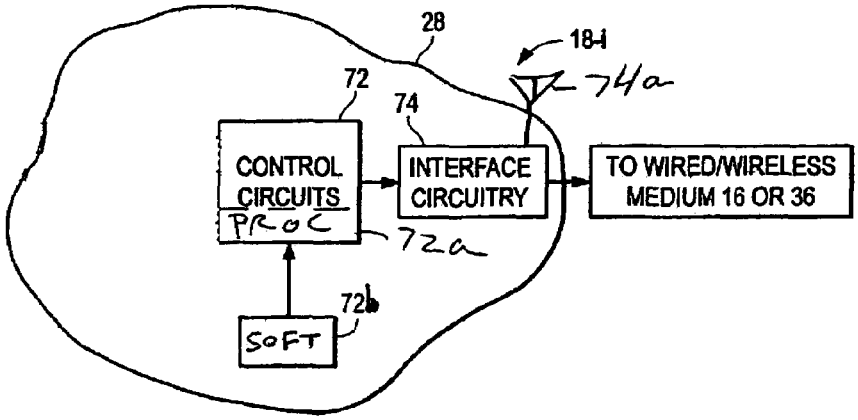
FIG. 2C is a block diagram of an exemplary local processing device usable in the system of FIG. 1.

FIG. 2C is a block diagram of a local processing device 18-i. Previously described components have been assigned the same identification numeral. Device 18-i could be coupled to either of media 16, 36 as desired. Local circuitry and software carry out CIS-mappable processing in response to received audio. Devices 18-i could also carry out processing of signals received at other devices such as 14 or 34. Control circuits 72, which can include a processor 72*a* and software 72 band/or other circuitry or logic to process received audio and generate a CIS-mappable value(s) as described above. They can communicate via interface circuits 74 using a wired medium, such as 16 or 36, or wirelessly 74*a*.

It will be understood that the implementations illustrated for devices 14-i and 34-i are exemplary only. Variations can be incorporated therein, as would be understood by those of skill in the art, depending on the specific application all without departing from the spirit and scope of the present invention. Among other variations, the acoustic sensors are exemplary only. Other forms of audio input transducers come within the spirit and scope of the invention.

Figure 3:
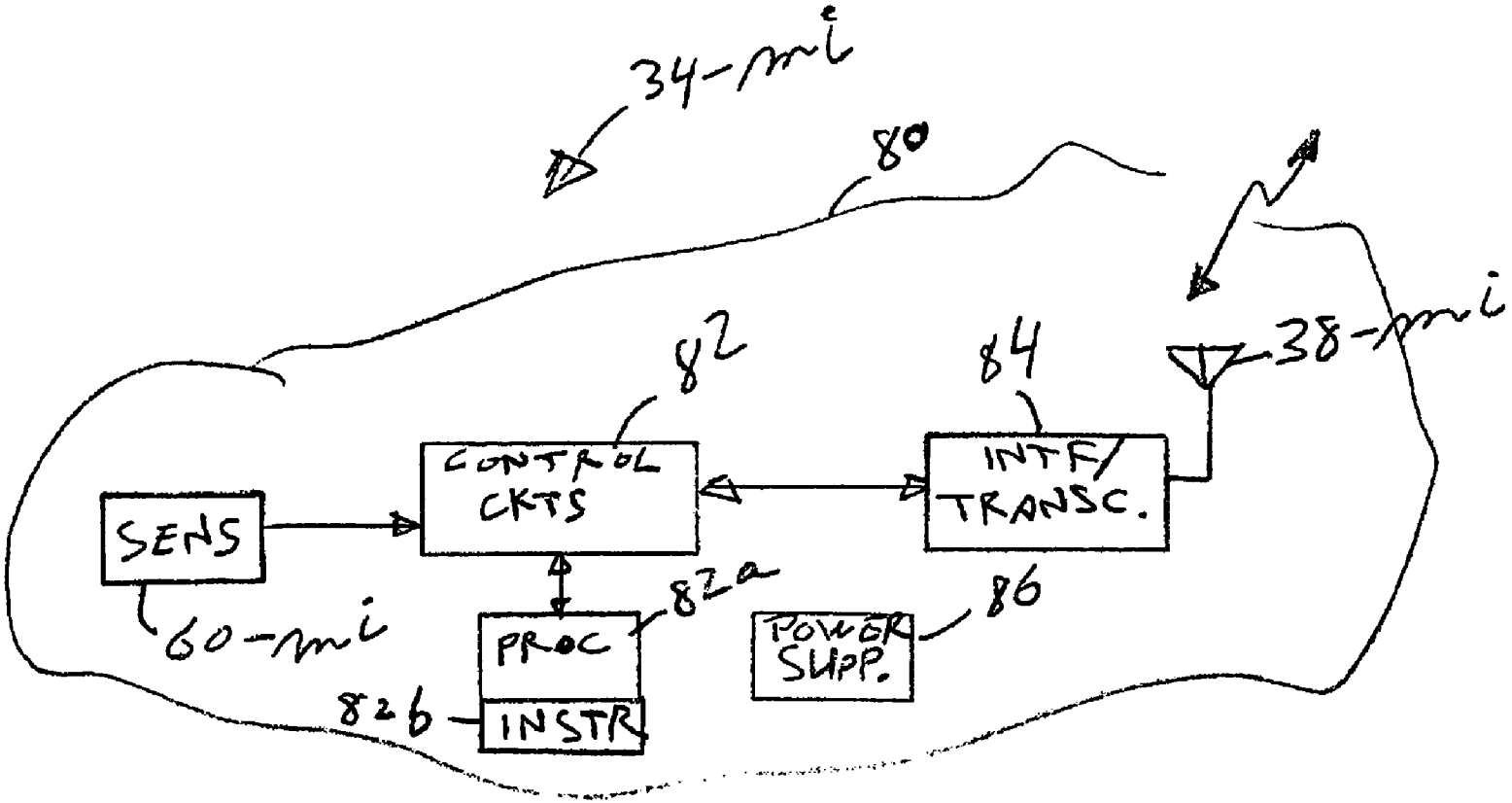
FIG. 3 is a block diagram of a wireless intelligibility evaluation device.

FIG. 3 is a block diagram of one of the wireless devices 34-mi. The device 34-mi is carried by a housing 80 which is mountable on any selected surface in the region R. Housing 80 can incorporate and carry an acoustic sensor 60-mi. It can also incorporate provisions for connections to several optional external acoustic sensors if desired.

The acoustic sensor(s) 60-mi, are in turn coupled to control circuits 82. Circuitry 82 can incorporate a programmed processor 82*a* for executing pre-stored instructions 82*b* for carrying out CIS-mappable processing and producing a value to the device 34-mi. The value can in turn be coupled via interface and transceiver 84, wirelessly via transducer 38-mi to one or more of the devices such as 34-i, 34-k (both in wired communication via medium 36 with unit 30), or any of the other wireless units which can function as repeaters such as 18-i, 34-m1, 34-m2 . . . 34-mn.

The wireless device 34-mi can also incorporate within housing 80 a power supply 86 which could for example be implemented as a self-contained energy supply, or, alternately receive electrical energy from an external source. The wireless device 34-mi is particularly advantageous in that it can be located anywhere in the region R independently of the wired medium 36 and without any need for an external source of electrical energy. Hence, the region R can be saturated with wireless units to promote intelligibility testing and evaluation at locations where heretofore it has been inconvenient to do so.

It will be understood that neither of the exact details of the wireless devices 34-mi nor the details of the wireless communication protocol described above, are limitations of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A system comprising:

a plurality of fixedly mountable acoustic sensors; and circuits coupled to respective acoustic sensors including circuitry for evaluating intelligibility of audio received by the respective acoustic sensors and generating an indicator of intelligibility on a per acoustic sensor basis and which includes at least one audio output device which output device produces audible speech intelligibility test signals which test signals will be received by the acoustic sensor to be evaluated by at least some of the circuits.

2. A system as in claim 1 where the circuits each include a wireless output port for communicating respective intelligibility indicators.

3. A system as in claim 2 which includes a plurality of wireless transceivers with at least some of the acoustic sensors and circuits in wireless communication with at least one of the transceivers.

4. A system as in claim 3 where at least some of the transceivers are coupled to a fire alarm control unit.

5. A system as in claim 1 which includes control circuits coupled to the audio output device, the control circuits couple electrical representations of the speech intelligibility test signals to the output device.

6. A system as in claim 5 which includes a plurality of audio output devices coupled to the control circuits.

7. A system as in claim 6 which includes a plurality of distributed ambient condition detectors selected from a class which includes smoke detectors, gas detectors and fire detectors.

8. A system as in claim 7 where at least some of the detectors carry respective ones of the acoustic sensors.

9. A system as in claim 5 where the control circuits include at least one of logic or executable instructions for producing speech intelligibility test signals to be audibly output by the at least one audio output device.

10. A system as in claim 9 which includes additional logic or executable instructions for processing the speech intelligibility test signals received from the respective microphones.

11. A method comprising:

locating a plurality of spaced apart wireless speech intelligibility evaluating devices in a region being monitored;

generating and outputting at least one audible speech intelligibility test signal in the region from received audio signals;

sensing said speech intelligibility test signal at at least one of the devices;

evaluating the intelligibility of the sensed speech intelligibility test signal;

wirelessly transmitting results of the evaluating to at least one displaced receiver.

12. A method as in claim 11 which includes generating a plurality of speech intelligibility test signals.

13. A method as in claim 11 which includes sensing the speech intelligibility test signal at a plurality of spaced apart devices.

14. A method as in claim 13 which includes:

wirelessly transmitting the evaluated results from the plurality of devices to a common site and then further storing and processing same.

15. A method as in claim 14 where the processing at the common site includes visually presenting processing results.

16. A method as in claim 14 which includes coupling a plurality of wireless transceivers to a control system.

17. A method as in claim 16 with the control system including a public address system and with the public address system including circuitry for transmitting received wireless evaluation results to a regional monitoring system.

18. An apparatus comprising:

at least one acoustic sensor;

control circuits coupled to the sensor, the control circuits establishing an intelligibility index in response to a received audio signal from the sensor;

at least one audio output device produces audible speech intelligibility test signals based on the intelligibility index, wherein test signals will be received by the acoustic sensor to be evaluated by some of the circuits;

a wireless transceiver coupled to the control circuits for wirelessly transmitting the results of the evaluation; and a housing which carries the sensor, the control circuits and the transceiver and which includes a network communications port.

19. An apparatus as in claim 18 which provides at least one port for connection of external acoustic sensors.

20. An apparatus as in claim 18 where the intelligibility index comprises at least one of STI, STI-PA RASTI, SII, or, a subset thereof.

21. An apparatus as in claim 18 where the intelligibility index comprises a CIS mappable value.

22. An apparatus as in claim 18 where the control circuits include a processor and executable instructions for carrying out CIS-mappable value processing.

23. An apparatus as in claim 18 where the communications port includes an interface for carrying out bi-directional communication via a medium.

24. An apparatus comprising:

an acoustic sensor with an electrical output corresponding to incident sound;

control circuits coupled to the acoustic sensor, the control circuits implementing common intelligibility scale (CIS)-mappable value processing in connection with incident sound; and said electrical output produces audible speech intelligibility test signals based on the CIS-mappable value, wherein test signals will be received by the acoustic sensor to be evaluated by some of the circuits;

a wireless communications port coupled to the control circuits for wirelessly transmitting the results of the evaluation.

25. An apparatus as in claim 24 which includes a housing attachable to a mounting surface.

* * * * *